US010730202B2

(12) United States Patent
Kalwa et al.

(10) Patent No.: US 10,730,202 B2
(45) Date of Patent: Aug. 4, 2020

(54) OSB (ORIENTED STRAND BOARD) WOOD MATERIAL PANEL HAVING IMPROVED PROPERTIES AND METHOD FOR PRODUCING SAME

(71) Applicant: SWISS KRONO Tec AG, Lucerne (CH)

(72) Inventors: Norbert Kalwa, Horn-Bad Meinberg (DE); Ingo Lehnhoff, Dierhagen (DE)

(73) Assignee: SWISS KRONO Tec AG, Lucerne (CH)

( * ) Notice: Subject to any disclaimer, the term of this patent is extended or adjusted under 35 U.S.C. 154(b) by 56 days.

(21) Appl. No.: 15/773,328

(22) PCT Filed: Nov. 3, 2016

(86) PCT No.: PCT/EP2016/076565
§ 371 (c)(1),
(2) Date: May 3, 2018

(87) PCT Pub. No.: WO2017/084884
PCT Pub. Date: May 26, 2017

(65) Prior Publication Data

US 2018/0319037 A1 Nov. 8, 2018

(30) Foreign Application Priority Data

Nov. 18, 2015 (EP) ..... 15195141

(51) Int. Cl.
*B27K 5/00* (2006.01)
*B27N 1/00* (2006.01)
(Continued)

(52) U.S. Cl.
CPC ..... *B27K 5/0085* (2013.01); *B27N 1/00* (2013.01); *B27N 1/003* (2013.01); *B27N 3/12* (2013.01);
(Continued)

(58) Field of Classification Search
CPC ..... B27K 5/0085; B27K 1/00; B27K 5/001; B27K 2200/15; B27K 2240/30;
(Continued)

(56) References Cited

U.S. PATENT DOCUMENTS 5,506,026 A 4/1996 Iwata et al.
5,641,819 A 6/1997 Campbell
(Continued)

FOREIGN PATENT DOCUMENTS

CN 101517177 A 8/2009
CN 102873720 A 1/2013
(Continued)

OTHER PUBLICATIONS

Thoeman et al., "Wood-Based Panels an Introduction for Specialists", 2010, Brunell University Press, London, England.
(Continued)

*Primary Examiner* — Stephen M Gravini
(74) *Attorney, Agent, or Firm* — The Webb Law Firm

(57) ABSTRACT

The invention relates to a method for producing OSB wood material panels, in particular OSB wood material panels having reduced emission of volatile organic compounds (VOCs), including the following steps: a) producing wood strands from suitable woods; b) torrefying at least some of the wood strands; c) glue-coating the torrefied wood strands and non-torrefied wood strands with at least one binder; d) scattering the glue-coated wood strands onto a conveyor belt; and e) pressing the glue-coated wood strands to form a wood material panel. The invention further relates to an OSB wood material panel that can be produced in accordance with said method and to the use of torrefied wood strands to reduce the emission of VOCs from OSB wood material panels.

26 Claims, 2 Drawing Sheets

(51) Int. Cl.
*B27N 3/12* (2006.01)
*B27K 1/00* (2006.01)

(52) U.S. Cl.
CPC ..... *B27K 1/00* (2013.01); *B27K 5/001* (2013.01); *B27K 2200/15* (2013.01); *B27K 2240/30* (2013.01); *B27K 2240/60* (2013.01); *B27K 2240/70* (2013.01)

(58) Field of Classification Search
CPC B27K 2240/60; B27K 2240/70; B27N 1/003; B27N 3/12
USPC ..... 34/393
See application file for complete search history.

(56) References Cited

U.S. PATENT DOCUMENTS

| | | | | |
|---|---|---|---|---|
| 5,678,324 | A | 10/1997 | Viitaniemi et al. | |
| 6,075,076 | A | 6/2000 | Speaks et al. | |
| 6,098,679 | A | 8/2000 | Go et al. | |
| 8,822,574 | B2 * | 9/2014 | Gunschera | B27N 1/003 423/239.2 |
| 8,865,318 | B2 * | 10/2014 | Maes | C08G 18/6492 428/532 |
| 9,238,767 | B2 * | 1/2016 | Braun | C08G 18/003 |
| 9,255,398 | B2 | 2/2016 | Griem | |
| 10,399,245 | B2 * | 9/2019 | Kalwa | B27K 5/0085 |
| 2005/0214537 | A1 * | 9/2005 | Pohlmann | E04B 1/80 428/403 |
| 2006/0143869 | A1 | 7/2006 | Pohlmann | |
| 2006/0243344 | A1 * | 11/2006 | Lund Nilsen | F17C 13/12 141/59 |
| 2008/0263890 | A1 | 10/2008 | Picard | |
| 2013/0331484 | A1 | 12/2013 | Braum et al. | |
| 2014/0363664 | A1 | 12/2014 | Gier et al. | |
| 2018/0319037 | A1 * | 11/2018 | Kalwa | B27K 5/0085 |
| 2018/0345529 | A1 * | 12/2018 | Kalwa | B27K 5/0085 |

FOREIGN PATENT DOCUMENTS

| | | | | |
|---|---|---|---|---|
| CN | 202866235 | U | 4/2013 | |
| EP | 1674224 | A1 | 6/2006 | |
| EP | 2447332 | A1 | 5/2012 | |
| EP | 2615126 | A1 | 7/2013 | |
| EP | 2765178 | A1 | 8/2014 | |
| EP | 2889112 | A1 | 7/2015 | |
| EP | 3170635 | B1 * | 12/2017 | B27K 5/0085 |
| FR | 2989016 | A1 | 10/2013 | |
| JP | H06155420 | A | 6/1994 | |
| JP | 9502508 | A | 3/1997 | |
| JP | 2013180460 | A | 9/2013 | |
| JP | 2014514192 | A | 6/2014 | |
| JP | 6518385 | B2 * | 5/2019 | B27K 5/0085 |
| WO | 2008038869 | A1 | 4/2008 | |
| WO | 2012168563 | A2 | 12/2012 | |
| WO | 2014056128 | A1 | 4/2014 | |
| WO | WO-2017084884 | A1 * | 5/2017 | B27K 5/0085 |

OTHER PUBLICATIONS

Wilen et al., "Wood Torrefaction—Market Prospects and Integration with the Forest and Energy Industry", 2014, VTT Technical Research Centre of Finland, Finland.

Fukino et al., "Production Technology for Strand-Particle Board (SPB) III Effect of isocyanate adhesives (EMDI) on physical properties and blisters", Japan Wood Research Society, 2007, pp. 187-193, vol. 53, No. 4.

Pelaez-Samaniego et al., "A review of wood thermal pretreatments to improve wood composite properties", Wood Science and Technology, 2013, pp. 1285-1319, vol. 47.

* cited by examiner

OSB (ORIENTED STRAND BOARD) WOOD MATERIAL PANEL HAVING IMPROVED PROPERTIES AND METHOD FOR PRODUCING SAME

CROSS-REFERENCE TO RELATED APPLICATIONS

This application is the United States national phase of International Application No. PCT/EP2016/076565 filed Nov. 3, 2016, and claims priority to European Patent Application No. 15195141.5 filed Nov. 18, 2015, the disclosures of which are hereby incorporated in their entirety by reference.

BACKGROUND OF THE INVENTION

Field of the Invention

The present invention relates to a process for the production of OSB-wood-composite boards, OSB-wood-composite boards produced with the process and the use of torrefied wood strands.

Description of Related Art

Higher density particle boards, also referred to as OSB boards (oriented strand boards), are wood-composite boards which are produced from long chips (strands). OSB boards, originally occurring as waste products of the veneer and plywood industry, are however increasingly being used in timber housing construction and prefabricated house building, since OSB boards are lightweight and yet meet the static requirements imposed on building boards. Thus, OSB boards are used as building boards and also as wall or ceiling planking or also in the floor area.

The production of OSB boards takes place in a multistage process, wherein the chips or strands are first peeled off from a debarked round wood, preferably softwoods, in the longitudinal direction by rotating blades. In the subsequent drying process, the natural moisture of the strands is reduced at high temperatures. The moisture content of the strands can vary depending on the adhesive used, wherein the moisture content should fall well below 10%, in order to prevent cracks in the subsequent pressing. Depending on the adhesive, wetting on rather moist strands or on dry strands may be more favourable. Moreover, as little moisture as possible should be present in the strands during the pressing process, in order to reduce as far as possible the vapour pressure arising during the pressing process, since the latter could otherwise cause the raw board to crack.

Following the drying of the strands, the latter are introduced into a gluing device, in which the glue or adhesive is applied finely distributed onto the chips. For the gluing, use is predominantly made of PMDI (polymeric diphenylmethane diisocyanate) or MUPF glues (melamine-urea-phenol-formaldehyde). The glues can also be used mixed into the OSB boards. These glues are used, since the OSB boards, as mentioned above, are often used for structural applications. Moisture-resistant or water-resistant glues have to be used there.

Following the gluing, the glued strands are scattered in scattering apparatuses alternately along and crosswise to the production direction, so that the strands are arranged crosswise in at least three layers (lower outer layer-middle layer-upper outer layer). The scattering direction of the lower and upper outer layer is the same, but they differ from the scattering direction of the middle layer. The strands used in the outer layer and the middle layer also differ from one another. Thus, the strands used in the outer layers are flat and the strands used in the middle layer are less flat to the extent of being chip-shaped. Usually, two material strands are run in the production of OSB boards; one with flat strands for the subsequent outer layers and one with "chips" for the middle layer. Accordingly, the strands in the middle layer can be of a lower quality, since the bending strength is essentially produced by the outer layers. Fine material, which arises in chipping, can thus also be used in the middle layer of OSB boards.

Following the scattering of the strands, continuous pressing of the latter takes place under high pressure and at high temperature of for example 200 to 250° C.

It is not least on account of their durability that OSB boards are enjoying ever greater popularity and diverse use, for example as a construction element in house building and as formwork in concrete construction. The hygroscopic properties inherent in wood components, however, have a disadvantageous effect in some applications.

The escape of substances contained in wood is regarded as critical especially when OSB is used in indoor areas. This is problematic especially in the case of OSB boards made from pine wood, since the latter exhibit particularly high emissions of volatile organic compounds.

A multiplicity of volatile organic compounds arise or are liberated in the course of producing wood composite boards and in particular caused by the production process of the wood strands. The volatile organic compounds, also referred to as VOCs, include volatile organic materials which readily evaporate or are present as gas even at lower temperatures, such as room temperature for example.

The volatile organic compounds VOC are either already present in the wood material and are liberated from the latter during the treatment or they are formed, according to the present state of knowledge, by the breakdown of unsaturated fatty acids, which in turn are decomposition products of wood. Typical transformation products, which arise during the processing, are for example pentanal and hexanal, but also octanal, octenal or 1-heptenal. Softwoods in particular, from which OSB boards are mainly produced, contain large quantities of resin and fats, which lead to the formation of volatile organic terpene compounds and aldehydes. VOC and aldehydes, such as formaldehyde, can however also arise or be liberated when use is made of certain adhesives for the production of the wood composites.

The emission of substances contained in OSB composite boards is primarily critical because this material is predominantly used uncoated. The contained substances can thus evaporate without hindrance. Moreover, the OSB boards are often used for the cladding/planking of large areas, as a result of which a high loading of the room ($m^2$ OSB/$m^3$ room air) usually results. This also leads to a concentration of certain substances in the room air.

In order to solve the problem of the VOC emission, various approaches have been described in the past. Thus, it emerges from EP 2 615 126 B1 that a reduction in the VOC emission in OSB boards can be brought about by the use of nanoparticles modified with silane compounds. The use of such nanoparticles in OSB boards is however associated with relatively high cost.

Accordingly, it is desirable to develop further solutions by means of which the liberation of readily volatile organic compounds from OSB-wood-composite boards is reduced.

A further problem in the production of OSB-composite boards consists in the tendency of the wood strands towards swelling, which can lead to a reduction of the technological values such as strength values of the OSB-wood-composite boards. An approach to reducing the tendency towards swelling is described for example on U.S. Pat. No. 6,098,679. A method and a device are shown here, with which OSB boards are pre-treated or post-treated to reduce the tendency towards swelling. For this purpose, the OSB board is subjected to superheated steam in a vacuum chamber.

A problem now underlying the invention is to improve the method known per se for the production of OSB-composite boards, in such a way that OSB composite boards with a greatly reduced emission of volatile organic compounds (VOCs) and with improved swelling values can be produced in a straightforward and reliable manner. If possible, the production process should be changed as little as possible and the costs should not increase disproportionately. Furthermore, the solution should have the greatest possible flexibility. Finally, ecological aspects should also be taken into account, i.e. the solution should not give rise to any additional energy consumption or additional wastes.

SUMMARY OF THE INVENTION

According to the invention, this problem is solved by a method for the production of OSB-wood-composite boards and an OSB-wood-composite board produced therefrom.

Accordingly, a method is provided for the production of OSB-wood-composite boards, in particular of OSB-wood-composite boards with reduced emission of volatile organic compounds (VOCs), which comprises the following steps:

a) production of wood strands made of suitable woods, b) torrefaction of at least a portion of the wood strands;

c) gluing of the torrefied wood strands and non-torrefied wood strands with at least one binder;

d) application, by scattering, of the glued wood strands to a conveyor belt; and e) pressing of the glued wood strands to give an OSB-wood-composite board.

The present method enables the production of OSB-wood-composite boards using torrefied wood strands, which are introduced into a known production process in addition or as an alternative to untreated wood strands. An OSB-wood-composite board produced with the process according to the invention and comprising torrefied wood has a reduced emission of volatile organic compounds, in particular of terpenes, organic acids such as acetic acid and aldehydes.

Various advantages arise as a result of providing the present process. Thus, a straightforward production of OSB-wood-composite boards is possible with a markedly reduced emission of volatile organic compounds from the OSB without significant influencing of the usual process chain whilst abandoning the conventional drying process. The produced OSB-wood-composite boards also have greatly reduced swelling and greater dimensional stability. As a result of using torrefied strands, which have a very low moisture content, products can also more easily be produced which are produced by the addition of aqueous formulations, wherein an adaptation of the water balance is possible.

Torrefaction is a thermochemical treatment process, wherein the material to be torrefied is heated in a low-oxygen-content or oxygen-free gas atmosphere under atmospheric pressure. On account of the lack of oxygen, the material does not combust, instead of which there is a loss of mass on account of the decomposition of wood components, which are broken down to form volatile compounds at the torrefaction temperatures. These are in particular hemi-celluloses and lignins. In addition, low-molecular compounds such as formic acid, terpenes, hydrocarbons etc. are expelled. Torrefied material is hydrophobic and therefore less susceptible to ambient moisture, so that the risk of rotting of torrefied material is extremely low.

The torrefaction step of the wood strands can be provided in various ways in the existing process.

In an embodiment of the present process, at least a portion of the wood strands used for the production of the OSB-wood-composite boards is dried before torrefaction, i.e. already dried or pre-dried wood strands, e.g. with a moisture content of 5 to 15% moisture, preferably 5 to 10% moisture, undergo torrefaction in this case.

In a further second embodiment of the present process, at least a portion of the wood strands is torrefied with a moisture content of 20 to 50% by weight, i.e. no prior drying of the wood strands takes place here, but rather the wood strands are fed to the torrefaction device without preliminary treatment after the chipping.

Accordingly, the present process enables the torrefaction of moist or dry wood strands. In particular, the torrefaction of moist wood strands is advantageous, since the drying step is saved.

In a further embodiment of the present process, torrefied wood strands, or a mixture of torrefied wood strands and untreated (i.e. non-torrefied) wood strands, are/is used as middle layer and/or outer layer of the OSB-composite board.

Accordingly, a complete substitution of the wood strands is possible in a variant, wherein the torrefied wood strands are used only in the middle layer, only in one or both outer layers or also in all the layers. The use of a dryer is dispensed with in this variant.

In another variant, it is possible to form only the middle layer from torrefied wood strands and to use dried and non-torrefied wood strands for one or both outer layers. Since the torrefied strands have a brown colour, it may accordingly be advantageous to use torrefied strands only in the middle layer.

In yet another variant, only one or both outer layers are formed from torrefied wood strands and dried and non-torrefied wood strands are used for the middle layer.

In yet another variant, it is feasible and possible to use a mixture with an arbitrary ratio of torrefied wood strands and non-torrefied wood strands in each case for the middle and outer layers. In such a case, the mixture can comprise between 10 and 50% by weight, preferably between 20 and 30% by weight of untreated or non-torrefied wood strands and between 50 and 90% by weight, preferably between 70 and 80% by weight of torrefied wood strands.

In a further variant of embodiment, the step of torrefaction of the wood strands can be carried out separately from the production process of the OSB-wood-composite boards. Accordingly, the torrefaction step in this variant of embodiment of the present process takes place outside the overall process or the process line. The wood strands are removed from the production process and introduced into the torrefaction device (e.g. torrefaction reactor). The torrefied wood strands can then be introduced, optionally after intermediate storage, e.g. directly before the gluing, back into the conventional production process. This enables a high degree of flexibility in the production process.

In a further variant of embodiment, the torrefaction step of the wood strands can be integrated into the production process of the OSB-wood-composite boards, i.e. the torrefaction step is incorporated into the overall process or process line and takes place online.

In this case, the torrefaction can take place directly after the chipping and preparation of the wood strands or not until after the sorting and separation of the wood strands according to the use of the wood strands for the middle layer or the outer layer. In the latter case, a separate torrefaction of the wood strands can take place corresponding to the torrefaction requirements for the wood strands used in the middle layer and outer layer.

The wood strands used in the present case can have a length between 50 to 200 mm, preferably 70 to 180 mm, particularly preferably 90 to 150 mm; a width between 5 to 50 mm, preferably 10 to 30 mm, particularly preferably 15 to 20 mm; and a thickness between 0.1 and 2 mm, preferably between 0.3 and 1.5 mm, particularly preferably between 0.4 and 1 mm.

In an embodiment, the wood strands have for example a length between 150 and 200 mm, a width between 15 and 20 mm, a thickness between 0.5 and 1 mm and a moisture content of max. 50%.

In a further variant of the present process, the wood strands are torrefied in at least one torrefaction reactor, preferably in two torrefaction reactors. The torrefaction reactor used in the present case can be constituted and operate as a batch plant or as a continuously operated plant.

As already mentioned above, wood strands used for the middle layer and the outer layers of the OSB-wood-composite board can respectively be torrefied separately in at least two torrefaction reactors. This enables an adaptation of the degree of torrefaction of the torrefied wood strands used in the middle and/or outer layer to the respective requirements and customer wishes.

The two employed torrefaction reactors are preferably connected or arranged in parallel in this case.

It is preferable if the wood strands are torrefied by heating in a low-oxygen-content or oxygen-free atmosphere under atmospheric pressure at a temperature of between 150° C. and 300° C., preferably between 200° C. and 280° C., particularly preferably between 220° C. and 260° C.

Torrefaction can be carried out under atmospheric pressure in the presence of an inert gas, preferably in nitrogen as a reaction gas or gas flow. It is also possible to use saturated steam, wherein in this case the torrefaction process takes place at temperatures between 160° C. and 200° C. and pressures of 6 bar to 16 bar.

The process of torrefaction is preferably terminated with a loss of mass of the wood strands of 10 to 30%, preferably 15 to 20%. The duration of the process varies depending on the quantity and nature of the initial material used and can amount to between 1 and 5 h, preferably between 2 and 3 h.

The pyrolysis gases liberated essentially from hemicelluloses and other low-molecular compounds during the torrefaction process are used to generate process energy. The quantity of formed gas mixture is sufficient as a gaseous fuel to operate the process self-sufficiently in terms of energy.

It is also preferable if, before gluing with a suitable binder, the torrefied wood strands are cooled in water. Thus, the torrefied wood strands can be cooled in a water bath, which ensures complete wetting with water. A wetting agent, which facilitates the wetting of the hydrophobic strands, can be added to the water.

The bringing of the wood strands into contact with the at least one binder in step c) preferably takes place by spraying or jetting the binder onto the wood strands. Many OSB plants thus operate with rotating coils (drums with atomiser gluing). Mixer-gluing would also be possible. Here, the strands are mixed intimately with the glue in a mixer by rotating vanes.

In an embodiment of the present process, a polymer adhesive is preferably used as a binder which is selected from the group containing formaldehyde adhesives, polyurethane adhesives, epoxy resin adhesives, polyester adhesives. As a formaldehyde-condensate adhesive, use can be made in particular of a phenol-formaldehyde resin adhesive (PF), a cresol/resorcinol-formaldehyde resin adhesive, urea-formaldehyde resin adhesive (UF) and/or melamine-formaldehyde resin adhesive (MF).

In the present case, the use of a polyurethane adhesive is preferred, wherein the polyurethane adhesive is present based on aromatic polyisocyanates, in particular polydiphenylmethane diisocyanate (PMDI), toluylene diisocyanate (TDI) and/or diphenylmethane diisocyanate (MDI), wherein PMDI is particularly preferred.

In the case of the use of PMDI adhesives, the quantity of binder used to glue the torrefied and non-torrefied wood strands is from 1.0 to 5.0% by weight, preferably from 2 to 4% by weight, in particular 3% by weight (based on the total quantity of the wood strands).

In a further embodiment of the present process, it is also possible to use more than one polymer adhesive. Thus, as a first polymer adhesive, use can be made of at least one polycondensation adhesive such as a polyamide, a polyester, a silicone and/or a formaldehyde-condensate adhesive, in particular a phenol-formaldehyde resin adhesive (PF), a cresol/resorcinol-formaldehyde resin adhesive, urea-formaldehyde resin adhesive (UF) and/or melamine-formaldehyde resin adhesive (MF), and as a second polymer adhesive, at least one polyaddition adhesive such as an epoxy resin adhesive, polycyanurate adhesive and/or a polyurethane adhesive, in particular a polyurethane adhesive based on polydiphenylmethane diisocyanate (PMDI). Such hybrid adhesive systems are known from EP 2 447 332 B1.

The following binder variants are particularly preferred: phenol-formaldehyde adhesive (PF); melamine-urea-formaldehyde resin adhesive (MUF); melamine-urea-phenol-formaldehyde resin adhesive (MUPF); PMDI adhesives and a combination of MUF/MUPF and PMDI adhesives. In the latter case, PMDI is preferably used as a binder for the middle layer and MUF or MUPF in the outer layers. The use of PMDI adhesives is particularly preferred for all the layers, i.e. for the outer layers and the middle layer.

It is also possible to add at least one flame protection agent to the wood strands, together or separately with the binder.

The flame protection agent can typically be added in a quantity between 1 and 20% by weight, preferably between 5 and 15% by weight, particularly preferably 10% by weight related to the total quantity of the wood strands.

Typical flame protection agents are selected from the group comprising phosphates, borates, in particular ammonium polyphosphate, tris(tri-bromoneopentyl)phosphate, zinc borate or boric acid complexes of multivalent alcohols.

The glued (torrefied and/or non-torrefied) wood strands are applied on a conveyor by scattering thereby forming a first outer layer along the transport direction, then by forming a middle layer crosswise to the transport direction and then by forming a second outer layer along the transport direction.

After the scattering, the pressing of the glued wood strands takes place at temperatures between 200 and 250° C., preferably 220 and 230° C. to give an OSB-wood-composite board.

In a first preferred embodiment, the present process for the production of an OSB-wood-composite board with reduced VOC emission comprises the following steps:

production of wood strands from suitable woods, in particular by means of chipping suitable woods, torrefaction of the wood strands without prior drying of the wood strands;

sorting and separating of the torrefied wood strands into wood strands suitable for use as a middle layer and an outer layer;

gluing of the separated torrefied wood strands;

application, by scattering, of the glued torrefied wood strands on a conveyor belt in the sequence first lower outer layer, middle layer and second upper outer layer; and pressing of the glued wood strands to give an OSB-wood-composite board.

In a second preferred embodiment, the present process for the production of an OSB-wood-composite board with reduced VOC emission comprises the following steps:

production of wood strands from suitable woods, in particular by means of chipping suitable woods, optionally, drying of the wood strands;

sorting and separating of the wood strands into strands suitable for use as a middle layer and an outer layer;

torrefaction of the wood strands intended for the middle layer and/or torrefaction of the wood strands intended for the outer layer(s);

gluing of the separated torrefied wood strands;

application, by scattering, of the glued torrefied wood strands on a conveyor belt in the sequence first lower outer layer, middle layer and second upper outer layer; and pressing of the glued wood strands to give an OSB-wood-composite board.

Accordingly, the present process enables the production of an OSB-wood-composite board with reduced emission of volatile organic compounds (VOCs), which comprises torrefied wood strands.

The OSB-wood-composite board produced with the present process has in particular a reduced emission of aldehydes, in particular pentanal or hexanal, organic acids such as acetic acid and/or terpenes, in particular carene and pinene, liberated during the wood digestion. Reference is made in this regard to the comments below.

The present OSB-wood-composite board can be made completely from torrefied wood strands or from a mixture of torrefied and non-torrefied wood strands.

The present OSB-wood-composite board has a swelling value reduced in comparison with an OSB-wood-composite boards produced entirely from non-torrefied wood strands, in particular a swelling value reduced by 20% to 50%, preferably 30% to 40%, e.g. by 35%. The tendency of OSB-wood-composite board towards swelling lies between 5 and 30%, preferably between 10 and 25%, particularly preferably between 15 and 20% (after 24 h storage in water).

The present OSB-wood-composite board can have a bulk density between 300 and 1000 kg/m$^3$, preferably between 500 and 800 kg/m$^3$, particularly preferably between 500 and 600 kg/m$^3$.

The thickness of the present OSB-wood-composite board can amount to between 5 and 50 mm, preferably between 10 and 40 mm, wherein a thickness between 15 and 25 mm is particularly preferred.

The problem of the present invention is also solved with the use of torrefied wood strands for reducing the emission of volatile organic compounds (VOCs) from OSB-wood-composite boards.

In a preferred variant, the torrefied wood strands are used for reducing aldehydes, organic acids and/or terpenes liberated during the wood digestion, in particular the chipping of the woods into strands.

Accordingly, the torrefied wood strands are used in the present case preferably for reducing the emission of organic acids, in particular for reducing the emission of acetic acid from OSB-wood-composite boards. Organic acids occur in particular as fission products of the wood components cellulose, hemicelluloses and lignin, wherein alkanoic acids, such as acetic acid and propionic acid or aromatic acids are preferably formed.

It is also desirable to use the torrefied wood strands for reducing the emission of aldehydes from OSB-wood-composite boards. As already explained above, a liberation of aldehydes takes place during the hydrolytic treatment of wood or ligocellulose. Specific aldehydes can be formed from the basic building blocks of cellulose or hemicellulose. Thus, for example, the aldehyde furfural is formed from mono- and disaccharides of cellulose or hemicellulose, while aromatic aldehydes can be liberated during the hydrolytic elimination of lignin which partially takes place. Accordingly, the torrefied wood strands are used for reducing the emission of C1-C10 aldehydes, particularly preferably of formaldehyde, acetaldehyde, pentanal, hexanal or also furfural in OSB-wood-composite boards.

In a further embodiment of the present invention, the torrefied wood strands are used for reducing the emission of terpenes. The torrefied wood strands can thus be used for reducing liberated terpenes, in particular C10-monoterpenes and C15-sesquiterpenes, particularly preferably acyclic or cyclic monoterpenes.

Typical acyclic terpenes are terpene hydrocarbons such as myrcene, terpene alcohols such as gerianol, linaool, ipsinol and terpene aldehydes such as citral. Typical representatives of monocyclic terpenes are p-menthane, terpeninol, limonene or carvone, and typical representatives of bicyclic terpenes are carane, pinane, bornane, wherein in particular 3-carene and α-pinene are important. Terpenes are components of tree resins and therefore particularly present in very resinous tree species such as pine and spruce.

BRIEF DESCRIPTION OF THE DRAWINGS

The invention is explained in greater detail below using an example of embodiment making reference to the figure of the drawing. In the figures.

DESCRIPTION OF THE INVENTION

Figure 1:
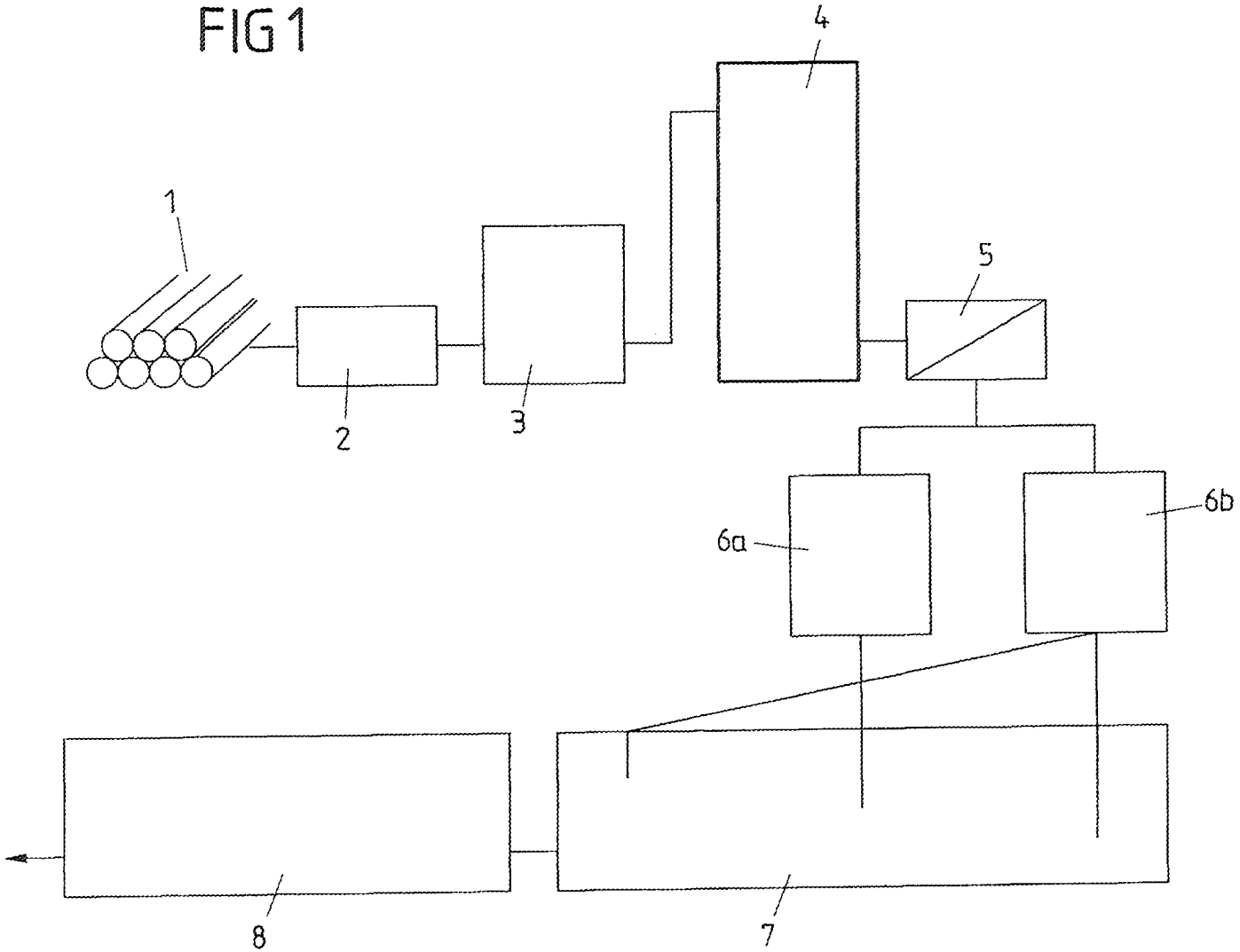
FIG. 1 shows a diagrammatic representation of a first embodiment of the process according to the invention.

The first embodiment of the process according to the invention shown in FIG. 1 describes the individual process steps starting with the provision of the initial wood product up to the finished OSB-wood-composite board.

Accordingly, suitable initial wood material is first provided in step 1 for the production of the wood strands. All softwoods, hardwoods or also mixtures thereof are suitable as initial wood material.

The debarking (step 2) and the chipping (step 3) of the initial wood material takes place in chipping machines suitable for this purpose, wherein the size of the wood strands can be duly controlled. Following the size-reduction and provision of the wood strands, the latter optionally undergo a preliminary drying process, wherein a moisture content of 5-10% compared to the initial moisture content of the wood chips is adjusted (not shown).

In the case of the embodiment shown in FIG. 1, the wood strands are introduced into a torrefaction reactor (step 4). The torrefaction of the wood strands takes place in a temperature range between 220° C. and 260° C. The pyrolysis gases or torrefaction gases thereby arising are used to generate the energy required for the process plant.

After completion of the torrefaction, which in the present case lasts approximately 2 hours, the torrefied wood strands are wetted, sorted and separated (step 5).

A separation into wood strands for use as a middle layer (step 6a) or as an outer layer (step 6b) takes place with the respective gluing.

The glued torrefied wood strands are applied, by spreading, on a conveyor belt in the sequence first lower outer layer, middle layer and second upper outer layer (step 7) and then pressed to give an OSB-wood-composite board (step 8).

Figure 2:
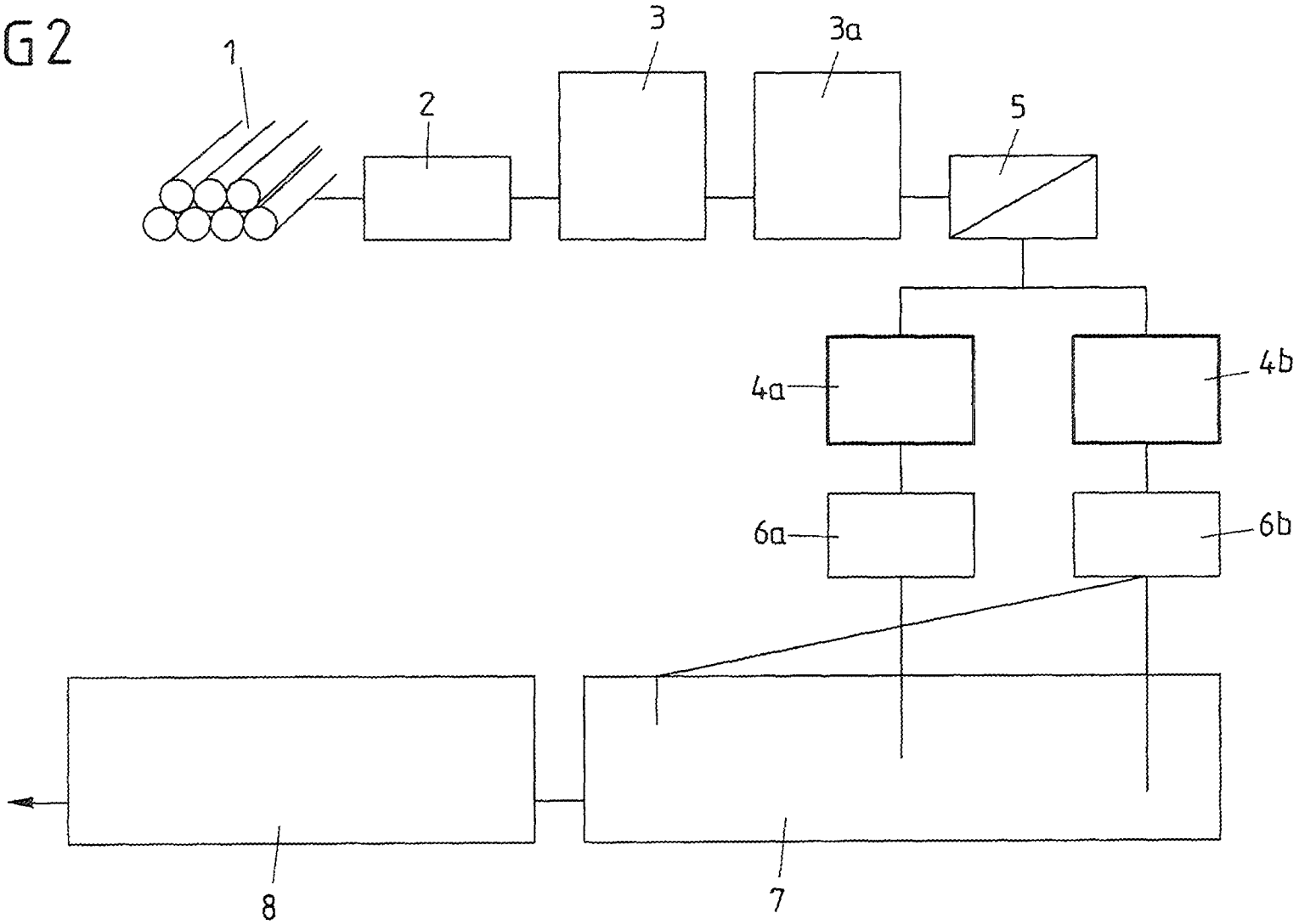
FIG. 2 shows a diagrammatic representation of a second embodiment of the process according to the invention.

In the second embodiment shown in FIG. 2, the initial wood material, by analogy with FIG. 1, is first provided (step 1), debarked (step 2) and chipped (step 3). The wood strands optionally undergo a preliminary drying process, wherein a moisture content of 5-10% compared to the initial moisture content of the wood strands is adjusted (step 3a).

In contrast with the variant of embodiment of FIG. 1, separation into wood strands for use as a middle layer or as an outer layer (step 5) already takes place after the optional drying.

This is followed by the torrefaction of the wood strands intended for the middle layer (step 4a) and/or torrefaction of the wood strands intended for the outer layer(s) (step 4b) in each case in a suitable torrefaction reactor. The torrefaction of the wood strands takes place in a temperature range between 220° and 260° C. The torrefaction can be adjusted to the desired degree of torrefaction for the middle layer and outer layers.

The pyrolysis gases or torrefaction gases thereby arising are used to generate the energy required for the process plant.

After completion of the torrefaction, which in the present case lasts approximately 2 hours, the torrefied wood strands are glued (steps 6 a,b).

The glued torrefied wood strands are applied, by spreading, on a conveyor belt in the sequence first lower outer layer, middle layer and second upper outer layer (step 7) and then pressed to give an OSB-wood-composite board (step 8).

In the final processing, the obtained OSB-wood-composite board is in each case suitably packaged.

Example of Embodiment

Strands are produced from pine trunks and torrefied in a continuously operating torrefaction apparatus at 180° C. up to a loss of mass of approximately 20%. This takes place under saturated steam. During the process, the strands change colour from bright yellow to bright brown. The strands are then cooled in water.

The binder (PMDI, approximately 3% by weight) is then applied in a gluing machine (gluing drum, for example from the firm Coil) finely distributed onto the torrefied wood strands. The glued torrefied strands are applied by scattering as a middle layer in an OSB plant.

The outer layer is formed from strands which have been dried in a drum-type dryer. The latter are also glued with PMDI as the glue (approximately 3% by weight). The strands are not additionally hydrophobized by for example paraffin emulsion, so that the tests subsequently to be carried out are not disrupted by the hydrophobing agent. The scattered strands are pressed in a Contipress to give OSB boards.

The percentage distribution between middle layer and outer layer is at least 70% to 30%. The strands are pressed to form boards, which have a bulk density of approximately 570 kg/m$^3$.

After a storage time of approximately one week, the test board was tested together with a standard board of the same thickness in a micro-chamber for the VOC emission.

Chamber parameters: temperature 23° C.; moisture content 0%; air through-flow 150 ml/min; air exchange 188/h; loading 48.8 m$^2$/m$^3$; sample surface 0.003 m$^2$, chamber volume: 48 ml.

The values of the most important parameters in terms of quantity are shown in table 1.

TABLE 1

| Parameter | Test board µg/m$^2$ × h | Standard board µg/m$^2$ × h |
|---|---|---|
| Hexanal | 1093 | 3164 |
| 3-Carene | 388 | 1962 |
| α-Pinene | 322 | 1174 |
| Pentanal | 78 | 354 |
| β-Pinene | 98 | 314 |

As can be seen from the results, the emissions of the parameters most important in terms of quantity are reduced by the factor 3 to 5.

In addition, the thickness swelling was also determined.

TABLE 2

| | Test board | Standard board |
|---|---|---|
| Swelling (24 h) in % | 18.3 | 27.44 |

As can be seen from the table, the swelling values are reduced by the use of torrefied strands by approximately 35%.

The invention claimed is:

1. A process for the production of OSB-wood-composite boards, comprising:

a) production of wood strands made of suitable woods, b) torrefaction of at least a portion of the wood strands to produce torrefied wood strands via heating in a low-oxygen-content or oxygen-free atmosphere under atmospheric pressure or elevated pressure at a temperature from 150° to 300° C.;

c) gluing of the torrefied wood strands and non-torrefied wood strands with at least one binder to produce glued wood strands;

d) application, by scattering, of the glued wood strands to a conveyor belt; and e) pressing of the glued wood strands to give an OSB-wood-composite board.

2. The process according to claim 1, wherein at least a portion of the wood strands is dried before torrefaction.

3. The process according to claim 1, wherein at least a portion of the wood strands is torrefied with a moisture content of 20 to 50% by weight.

4. The process according to claim 1, wherein the torrefied wood strands, or a mixture of the torrefied wood strands and the non-torrefied wood strands, are/is used as middle layer and/or outer layer of the OSB-wood-composite board.

5. The process according to claim 1, wherein the wood strands are torrefied in at least one torrefaction reactor.

6. The process according to claim 1, wherein the wood strands used for the middle layer and the outer layers of the OSB-wood-composite board are respectively torrefied separately in at least two torrefaction reactors.

7. The process according to claim 1, wherein, before gluing with a suitable binder, the torrefied wood strands are cooled in water.

8. The process according to claim 1, wherein a quantity of binder used to glue the torrefied and the non-torrefied wood strands is from 1.0 to 5.0% by weight based on the total quantity of the wood strands.

9. The process according to claim 1, wherein the glued wood strands are pressed at temperatures of from 200 to 250° C. to give an OSB-wood-composite board.

10. An OSB-wood-composite board with reduced emission of volatile organic compounds (VOCs) which can be produced in the process according to claim 1 comprising torrefied wood strands.

11. The OSB-wood-composite board according to claim 10, further comprising reduced emission of terpenes and/or organic acids and/or aldehydes liberated during a wood digestion.

12. The OSB-wood-composite board according to claim 10, further comprising a swelling value reduced in comparison with an OSB-wood-composite boards produced entirely from the non-torrefied wood strands.

13. The OSB-wood-composite board according to claim 10, wherein the OSB-wood-composite board is composed entirely of the torrefied wood strands or of a mixture of the torrefied and the non-torrefied wood strands.

14. Use of torrefied wood strands for reducing the emission of volatile organic compounds (VOCs) from OSB-wood-composite boards.

15. The process according to claim 1, wherein the OSB-wood-composite boards comprise OSB-wood-composite boards with reduced emission of volatile organic compounds (VOCs).

16. The process according to claim 5, wherein the wood strands are torrefied in two torrefaction reactors.

17. The process according to claim 7, wherein the temperature is between 220° C. and 260° C.

18. The process according to claim 8, wherein a quantity of binder used to glue the torrefied and the non-torrefied wood strands is from 2 to 4% by weight based on the total quantity of the wood strands.

19. The process according to claim 9, wherein the glued wood strands are pressed at a temperature from 220° C. to 230° C.

20. A process for the production of OSB-wood-composite boards, comprising:

a) production of wood strands made of suitable woods;

b) torrefaction of at least a portion of the wood strands by heating in a saturated steam at temperatures between 160° C. and 200° C. and pressures of 6 bar to 16 bar;

c) gluing of the torrefied wood strands of step b) and of non-torrefied wood strands with at least one binder;

d) application, by scattering, of the glued wood strands to a conveyor belt; and e) pressing of the glued wood strands to give an OSB-wood-composite board.

21. The process according to claim 4, wherein torrefied wood strands are used as the middle layer and non-torrefied wood strands are used as both of the outer layers of the OSB-wood-composite board.

22. The process according to claim 1, wherein step b) of torrefication of the wood strands is carried out separately from the production process of the OSB-wood-composite board.

23. The process according to claim 22, wherein the wood strands are removed from the production process and introduced into the torrefication device.

24. The process according to claim 22, wherein the torrefied wood strands are introduced back into the production process before gluing in step c).

25. The process according to claim 8, wherein the torrefication is terminated with a loss of mass of the wood strands of 10 to 30%, preferably 15 to 20%.

26. The process of claim 7, wherein the binder is a polyurethane adhesive based on aromatic polyisocyanates, in particular polydiphenylmethane diisocyanate (PMDI), toluylene diisocyanate (TDI) and/or diphenylmethane diisocyanate (MDI).

* * * * *